US005259947A

United States Patent [19]

Kalback et al.

[11] Patent Number: 5,259,947

[45] Date of Patent: Nov. 9, 1993

[54] SOLVATED MESOPHASE PITCHES

[75] Inventors: Walter M. Kalback; H. Ernest Romine, both of Ponca City, Okla.; Xavier M. Bourrat, Bordeaux, France

[73] Assignee: Conoco Inc., Ponca City, Okla.

[21] Appl. No.: 762,711

[22] Filed: Sep. 19, 1991

Related U.S. Application Data

[63] Continuation-in-part of Ser. No. 632,259, Dec. 21, 1990, abandoned.

[51] Int. Cl.[5] ..... C10C 3/02

[52] U.S. Cl. ..... 208/44; 208/22; 208/39; 208/45

[58] Field of Search ..... 208/22, 39, 44, 45

[56] References Cited

U.S. PATENT DOCUMENTS 4,465,586 8/1984 Diefendorf et al. ..... 423/447.4

5,032,250 7/1991 Romine et al. ..... 208/39

*Primary Examiner*—Theodore Morris

*Assistant Examiner*—P. L. Hailey

[57] ABSTRACT

This invention relates to low melting solvated mesophase pitches which are suitable for spinning into carbon fibers. The solvated mesophase pitches have a lower melting point than conventional mesophase pitch but remain substantially anisotropic. The solvated mesophase can be produced as an intermediate during solvent fractionation or supercritical solvent fractionation of mesogen-containing isotropic pitches. The process is enhanced through the ability to recover pseudomesogens with an increased average molecular weight which, in combination with the solvent content, provides a fusible mesophase capable of being spun directly into infusible oriented anisotropic carbon fibers.

20 Claims, 12 Drawing Sheets

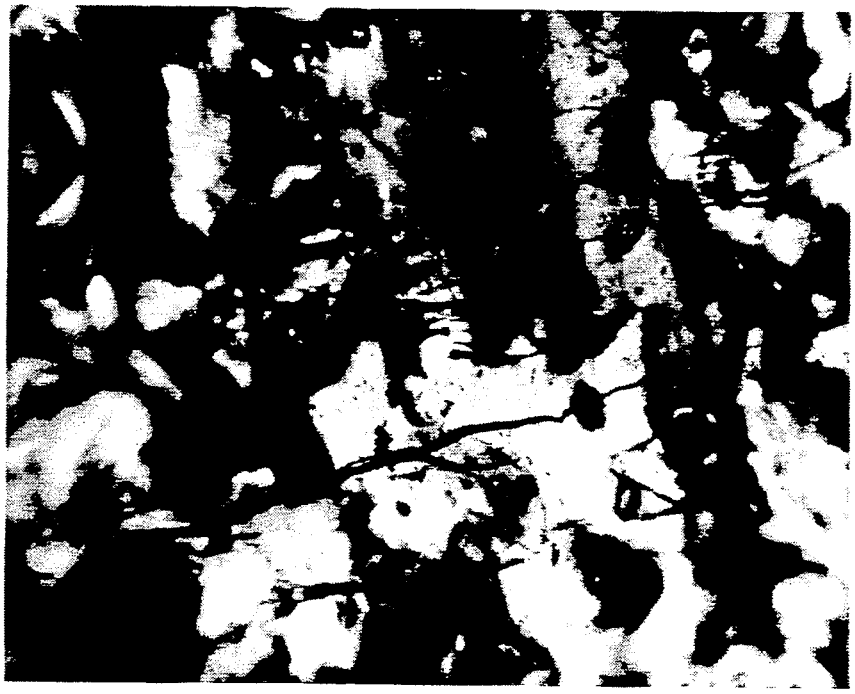
FIG. 18
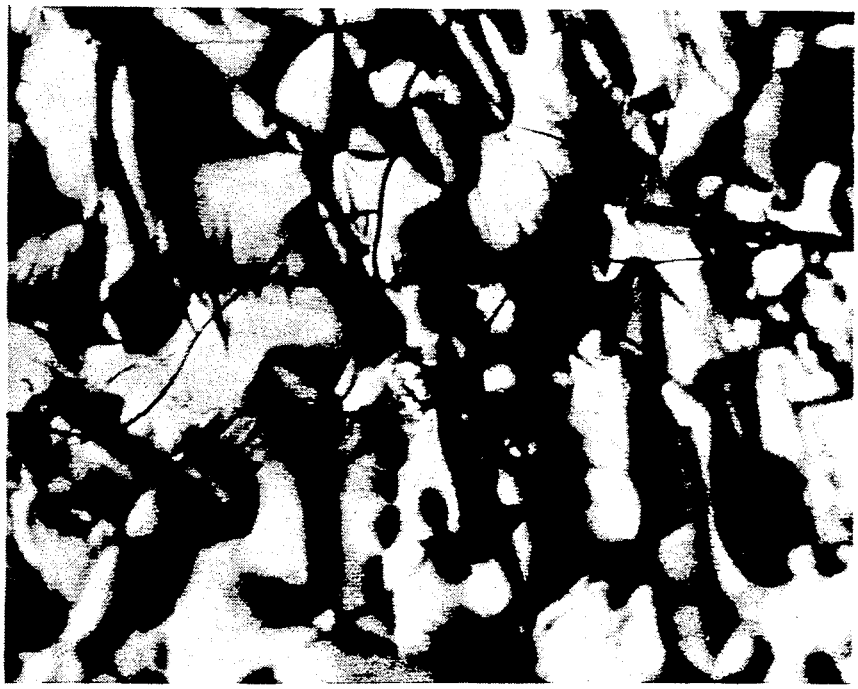

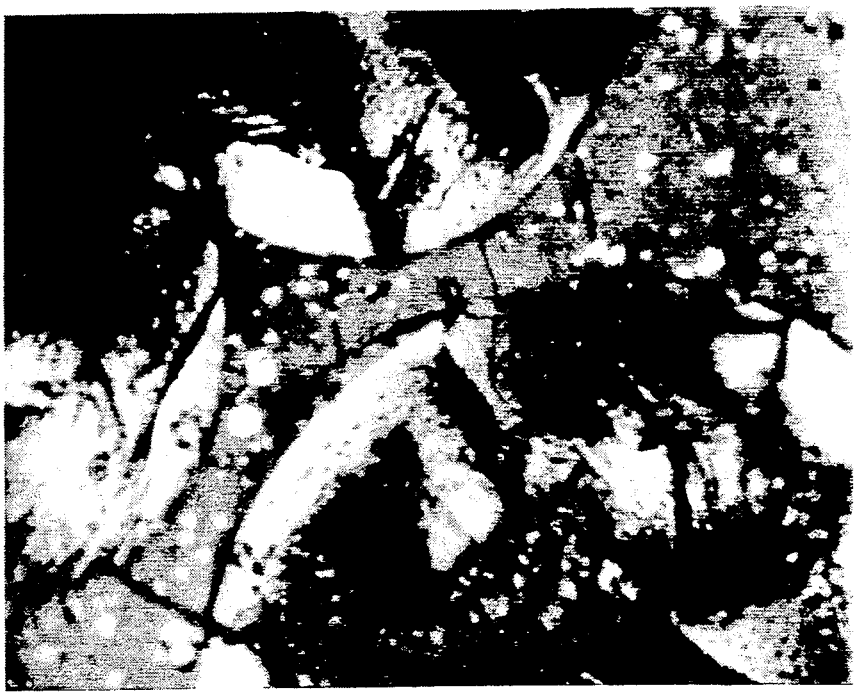

SOLVATED MESOPHASE PITCHES

This application is a continuation-in-part of U.S. patent application Ser. No. 07/632,259, filed Dec. 21, 1990, and entitled "Solvated Mesophase Pitches", now abandoned.

BACKGROUND AND SUMMARY

This invention relates to mesophase pitches. These pitches show an ordered liquid crystalline structure wherein the aromatic pitch molecules associate to form a somewhat sheet-like arrangement. The ordered liquid crystalline structure of mesophase pitch makes such pitches especially suitable for forming ordered structural artifacts such as pitch carbon fibers.

It has long been known that carbon fibers can be produced from mesophase pitches. These fibers have excellent properties suitable for commercial uses because of their light weight and thermal and electrically conductive properties, as well as being strong and stiff. These fibers are normally chemically and thermally inert, and usually find use as reinforcements in composites such as aerospace applications.

Pitch carbon fibers are generally of two types. One type of carbon fiber is produced from isotropic pitches which exhibit little molecular orientation and have relatively poor mechanical properties. However, the second type of carbon fiber is those produced from mesophase pitch, (or optically anisotropic pitches) which exhibit highly aligned molecular orientation providing excellent mechanical properties and extremely high modulus values.

Various processes are known to produce mesophase pitches. All known processes have two common elements, one being a growth reaction wherein relatively small aromatic molecules are converted into larger mesophase-size aromatic molecules known as mesogens. The second element is a concentration of these mesogens to form mesophase pitch.

Concentration involves removal of smaller aromatics and sometimes includes removal of excessively large aromatics. Techniques well known for accomplishing these end results include solvent extraction, distillation, gas stripping and phase separation. We have discovered supercritical solvent extraction can also be used.

Mesophase pitches suitable for spinning into pitch carbon fibers have from 40 to 100 percent optical anisotropic content and from 0 to near 100 percent quinoline insolubles. Suitable pitches should form a homogenous melt. Suitable pitches having a melting point in the range of 250° C. to 380° C. have been reported. Spinning into fibers becomes a problem because of pitch thermal instability above about 350° C. and therefore pitches melting at 310° C. to 350° C. or lower are preferrd.

As-spun fibers melt at about the same temperature as the spinnable pitch. These fibers require oxidative stabilization to become infusible before they can be converted to carbon or graphite fiber at temperatures of 1000° C. or higher. The stabilization step is highly exothermic. Great care must be taken to control stabilization so that the treatment is uniform and so that partial melting does not occur. The required slow careful stabilization is expensive and adds significantly to the cost of pitch based carbon fiber.

It would therefore be of great benefit to provide an anisotropic pitch which is fluid at much lower temperature than conventional mesophase. It would also be of great benefit if the lower melting anisotropic pitch was much higher melting after spinning. Other objects will become apparent to those skilled in this art as the description proceeds.

For the purposes of this specification and claims the following terms and definitions are used:

"Anisotropic pitch" or "mesophase pitch" means pitch comprising molecules having aromatic structures which through interaction are associated together to form ordered liquid crystals, which are either liquid or solid depending on temperature.

"Fibers" means continuous lengths of fiber capable of formation into useful articles, and comprises both continuous filaments and fibrils.

"Fibrils" means small filaments of varying lengths.

"Isotropic pitch" means pitch comprising molecules which are not aligned in ordered liquid crystals.

"Mesogens" means molecules which when melted or fused form mesophase pitch and comprise a broad mixture of large aromatic molecules which arrange upon heating to form liquid crystals.

"Oriented Molecular Structure" means the alignment of aromatic pitch molecules in formed carbon-containing artifacts, wherein said alignment provides structural properties to the artifact.

"Petroleum pitch" means to the residual carbonaceous material obtained from the catalytic or thermal cracking of petroleum distillates or residues.

"Petroleum coke" means the solid infusible residue resulting from high temperature thermal treatment of petroleum pitch.

"Pitch" as used herein means substances having the properties of pitches produced as by-products in various industrial production processes such as natural asphalt, petroleum pitches and heavy oil obtained as a by-product in the naphtha cracking industry and pitches of high carbon content obtained from coal.

"Pitch oils" means those portions of a pitch that can be distilled or evaporated by such techniques as vacuum distillation, wiped film evaporation or sparge gas stripping. Most pitches including mesogens, pseudomesogens, and solvated mesophase contain pitch oils.

"Pseudomesogens" means materials which are potentially mesophase precursors, but which normally will not form optically ordered liquid crystals upon heating, but will directly form a solid coke upon heating, such that there is no melting or fusing visible.

"Solvated mesophase" means a material having a mesophase liquid crystalline structure which contains of between 5 and 40 percent by weight of solvent in the liquid crystal structure, the remainder comprising of mesogen or pseudomesogen pitch, and which melts or fuses at a temperature of at least 40° C. lower than the pitch component when not associated with solvent in the structure.

"Solvent Content" when referring to solvated mesophase is that value determined by weight loss on vacuum separation of the solvent. In this determination, a sample free of entrained or trapped solvent is obtained. The sample is accurately weighed, crushed and then heated to 150° C. during 1 hour in a vacuum oven at 5 mm pressure. The sample is then heated to 360° C. during 1 hour and held at 360° C. under vacuum for ½ hour. The weight loss or difference in weight times 100 divided by the original sample weight is the percent solvent content.

THE PRESENT INVENTION

The present invention is solvated mesophase comprising a solution of solvent in mesogens or pseudomesogens wherein the solvated mesophase is at least 40 percent by volume optically anisotropic and wherein the solvated mesophase melts at least 40° C. lower than the mesogen component. When the solvated mesophase contains pseudomesogens, then the solvated mesophase melts or fuses and the pseudomesogens do not. The invention also comprises methods for obtaining solvated mesophase, which is isolated during the solvent or supercritical solvent fractionation of certain pitches.

PRIOR ART

Mesophase pitch is not ordinarily available in existing hydrocarbon fractions which are obtained from refining fractions, coal fractions, coal tars or the like. Mesophase pitch however, can be prepared by the treatment of aromatic feedstocks, which treatment is well known in the art. The treatment generally involves a heat treatment step when large aromatic molecules are produced and a separation step where the large aromatic molecules are isolated or concentrated to form mesophase pitch. The heat treatment usually involves one or more heat soaking steps with or without agitation and with or without gas sparging or purging. Gas sparging may also be used to accomplish the separation step by evaporating smaller feed molecules. Gas sparging may be carried out with an inert gas or with an oxidative gas, or with both types of operations. Another method of accomplishing the separation step is solvent fractionation wherein the smaller molecules are removed by solvents, thereby concentrating the large molecules.

U.S. Pat. Nos. 4,277,324; 4,277,325; and 4,283,269 all relate to solvent fractionation processes for treating a carbonaceous pitch which consists of fluxing the pitch with a solvent, removing fluxing solubles from the mixture, precipitating the pitch by adding an anti-solvent to the flux filtrate and separating a neomesophase fraction from the precipitated material by filtration. The result is a mesophase pitch (neomesophase) having a melting point of up to about 380° C.

U.S. Pat. No. 3,558,468 relates to the extraction of a coal, coal tar fraction or a pitch with solvent under supercritical conditions. The material is not heat treated and the reference does not disclose isolation of mesophase.

U.S. Pat. No. 4,756,818 relates to the extraction of coal tar pitch with a supercritical gas and an entraining agent. Mesophase is then extracted with supercritical gas and entraining agent to give at least 75 percent mesophase. The process is carried out under supercritical conditions as to the gas, but with subcritical conditions as to the entrainer. Entrainers include benzene and methylnapthlene.

Japanese Patent 85,170,694 relates to a process for supercritically extracting pitch with an aromatic solvent to remove insolubles. The extraction is performed on a 2 to 1 volume basis of solvent to pitch. The solvent is separated from the pitch and the pitch is heated in vacuum or by sparging with an inert gas.

Japanese Patent 87,15,287 relates to a process for removing quinoline insolubles from petroleum pitch by supercritical extraction using an aromatic hydrocarbon solvent.

Copending U.S. patent application 07/288,585 filed Dec. 22, 1988 and titled: "Process for Isolating Mesophase Pitch" teaches recovery of mesophase pitches using supercritical solvent techniques.

BRIEF DESCRIPTION OF THE FIGURES

FIGS. 5A through 5D are a series of high resolution TEM 002 darkfield micrographs of the small area inside the square in FIG. 4. Anisotropic regions brighten and darken in FIGS. 5A through 5D as the selected direction for darkfield imaging, shown by a bar in the picture, is rotated. The brightening and darkening that accompanies rotation allows mapping of the molecular orientation in the sample.

FIG. 17 is an optical micrograph of the 98% anisotropic toluene/tetralin solvated mesophase of Example 9.

FIG. 18 is an optical micrograph of the fully anisotropic solvated mesophase of Example 10.

FIG. 19 is an optical micrograph of the quinoline solvated mesophase of Example 11. Three large regions of coalesced mesophase are seen along with a band of isotropic pitch. Small mesophase spheres are present in the isotropic material.

DETAILED DESCRIPTION OF THE INVENTION

Figure 1:
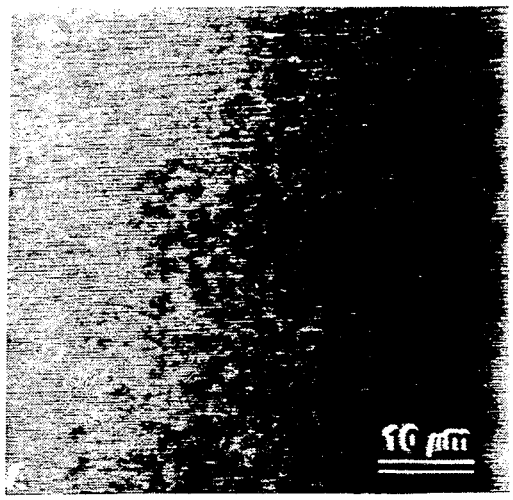
FIG. 1 is an optical micrograph which shows precipitated mesogens obtained from the rejection step of the solvent fractionation process. The rejection was done at 28° C. as described in Example 3. The precipitated mesogens lack optical anisotropy. They show uniform featureless istropic texture.
Figure 2:
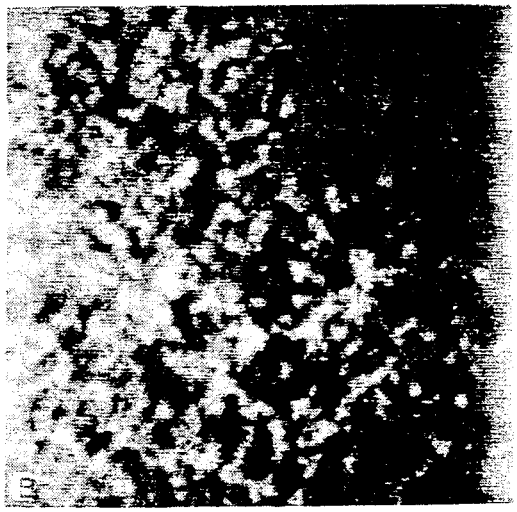
FIG. 2 is an optical micrograph which shows the effect of warming on the fine particulate material of FIG. 1. The material was heated to 83° C. in the rejection mixture as described in Example 1. At 83° C. in the presence of the solvent mix, the particles become tacky and begin to stick together. Particles isolated under these conditions begin to show optical textures indicative of mesophase domains. The particles are the light colored material.

Solvated mesophase pitches of the present invention are a unique material in that they contain homogenous fluid liquid crystals melting much lower than the mesogens contained within the fluid liquid crystal. Solvated mesophase pitch likewise can contain "pseudomesogens" which are mesogen-like materials which, when heated to cause melting, go directly to coke. It should be understood that the difference between mesogens and pseudomesogens is based on melting temperature but that no sharp boundary exists. Both mesogens and pseudomesogens are complex mixtures of large aromatic molecules. On the average, pseudomesogens are higher molecular weight and therefore higher melting than mesogens. To illustrate, consider the solvent fractionation of an isotropic pitch under conditions such that the insolubles are meltable mesogens (sometimes called neomesophase formers). If the dissolving power of the solvent is increased (solvent is more aggressive), the amount of insolubles decreases and the insolubles are higher melting. Further increases in solvent dissolving power give insolubles that are coke or that melt at temperatures so high that rapid coking occurs before the melting temperature is reached. Such insolubles are pseudomesogens. Of course the selection of the pitch and process conditions influence the melting temperature of solvent fractionation insolubles in addition to solvent dissolving power. In general, mesogen-like behavior is seen in insolubles that melt at temperatures of 450° C. and lower. Pseudomesogen behavior can be observed in insolubles melting at 380° C. and higher. Mixed behavior can occur around the overlapping temperature range depending on the nature of the insolubles and the rate of heating during melting.

Thus, solvated mesophase comprising a solution of solvent and mesogens or pseudomesogens, wherein the solvated mesophase is at least 40 area percent optically anisotropic can be obtained, wherein the solvated mesophase melts at least 40° C. lower than the mesogen component or where the solvated mesophase contains pseudomesogens, the solvated mesophase melts or fuses and the pseudomesogens do not. The mesophase content of solvated mesophase can be as high as 100%. The solvated mesophase sometimes melts 200° C. or more lower than the melting temperature of the mesogens alone. This is most clearly illustrated with reference to the solvated mesophase product of Example 10. This 100% anisotropic pitch is very fluid at the 233° C. extraction temperature. This is lower melting than any previously reported 100% anisotropic carbonaceous mesophase. When solvent is removed from this pitch, the residue can be heated to 650° C. at 5° C. per minute without evidence of melting.

The mesogens and pseudomesogens that form solvated mesophase are broad mixtures of large aromatic molecules. Because of the liquid crystal forming tendency of these materials, they are generally recognized as graphitizable.

Not all mesogens or pseudomesogens are suitable for forming solvated mesophase. Suitable materials usually show substantial solubility in aggressive solvents. Solvated mesophase forms readily in substantially quinoline soluble mesogens. Less soluble mesogens require aggressive solvents such as quinoline in order to form solvated mesophase. Solvated mesophase has been observed to form with mesogens and pseudomesogens having less than 25% quinoline insolubles.

While the characteristics of suitable mesogens and pseudomesogens have been described, not all substantially quinoline soluble, graphitizable, large aromatics form solvated mesophase.

The solvated mesophases of the present invention are mixtures of mesogens, pseudomesogens, solvent and pitch oil. Pitch oils are always present in the solvent phase in systems where solvated mesophase in equilibrium with excess solvent has been observed. These oils distribute between the phases and contribute to solvated mesophase composition and properties.

The solvated mesophase pitches obtained by the present invention contain amounts of solvent ranging from about 5 to about 40 weight percent. The amount of solvent in solvated mesophase will vary depending upon the pitch and the solvent used. However normally, utilizing toluene as a solvent, the solvent content appears to range from about 15 to 30 percent by weight at saturation. While the exact structure of solvated mesophase is not known, the incorporation of solvent in solvated mesophase appears to be loosely analogous to water of crystallization in chemistry.

The solvent content of solvated mesophase, as defined in this specification, includes some pitch oil components. The percent solvent measurement involves heating in vacuum to 150° C. and then to 360° C. In order to better describe the solvent, the 150° C. dried pitch was weighed for a number of the examples. It was always observed that about two-thirds of the total solvent was removed at 150° C. Pitch oils are not evolved at these conditions. The remaining one-third of the total solvent is removed on further heating to 360° C. Some pitch oils are contained in this fraction.

The present invention also includes solvated mesophase compositions with less than the saturation amount of solvent but which meet the criteria of melting 40° C. or more below the mesogen melting temperature and which contain solvent in a substantially (>40%) anisotropic pitch. In this respect solvated mesophase is distinguished from the "water of crystallization" analogy. Solvated mesophase occurs in a continuum of compositions wherein the solvent amount is at saturation down to where there is just enough solvent to cause a beneficial melting temperature lowering. Therefore, compositions having as little as 5% or even 2% solvent can be useful.

The melting point lowering of 40° C. is sufficient to cause a significant benefit during oxidative stabilization of pitch artifacts. Oxidative stabilization of pitch occurs more rapidly at higher temperatures. In practice, relatively long, low temperature oxidations are required to preclude any softening or melting of pitch fibers during oxidation. The oxidation must be carried out well below the spinning temperature. With solvated mesophase, the melting point of the pitch increases 40° C. or more on spinning and evaporation of solvent. This permits more rapid, higher temperature stabilization than would otherwise be possible and stabilization is often possible at above the spinning temperature. This characteristic also facilitates stabilization of relatively large diameter fibers and mesophase artifacts.

The solvents which can be utilized for the formation of solvated mesophase pitches are normally aggressive solvents; that is, solvents which are the better solvents for large aromatic molecules. Representative but nonexhaustive examples of these solvents include toluene, benzene, xylene, tetralin, tetrahydrofuran, chloroform, pyridine, quinoline, halogenated benzenes and chlorofluorobenzenes. Also included, individually and in mixtures, are 2 and 3 ring aromatics and their partly alkylated or hydrogenated derivatives. The aggressiveness or effectiveness of these solvents can be modified by blending these solvents with a poorer solvent such as heptane in various ratios. Thus, a 100 percent toluene solution would be much more aggressive than a mixture of 70 parts toluene to 30 parts heptane. Processing variables such as solvent ratio or extraction temperature also influence solvent aggressiveness.

Solvated mesophase can be described as a unique low melting liquid crystalline form of mesophase which is composed of mesogens and/or pseudomesogens and solvent.

Low melting temperature is a key property of solvated mesophase. Melting point lowering of at least 40° C. and often 200° C. or more compared to the melting temperature of the solvent free pitch components is observed in solvated mesophase.

Accurate melting temperatures of solvated mesophase can be difficult to obtain because standard melting techniques would result in loss of solvent. For this reason, melting behavior is often inferred from fluidity. If a solvent saturated solvated mesophase is heated in an autoclave containing excess solvent, the product appearance indicates whether melting occurred. A dense cake of solvated mesophase on the reactor bottom shows fluidity. A heavy coating on the vessel walls indicates at least partial melting while a granular particulate solid phase indicates no melting.

Tests to more quantitatively measure fluidity can be developed under conditions where the solvent is retained. Techniques such as penetration or extrusion indicate softening. Pressurized pump around systems can be designed to measure viscosity above the melting temperature.

Figure 7A:
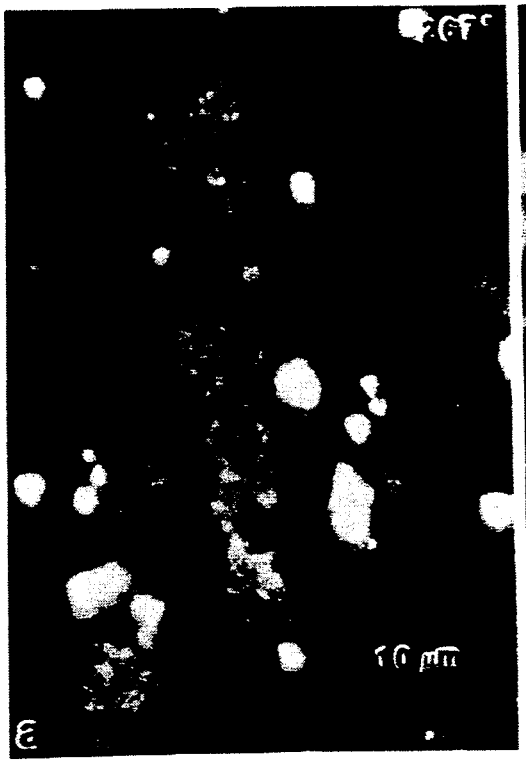
FIGS. 7A through 7D show the melting behavior of a conventional solvent fractionated neomesophase former fraction as described in Example 4. The fraction is composed of mesogens from solvated mesophase, now stripped of solvent, and a small amount of isotropic pitch coating such as seen in FIG. 4. The optical texture in FIG. *7a* formed at 100° C. while the pitch was in a low melting solvated state. Without solvent, this texture remains essentially unchanged until the solvent free mesogens begin to melt near 290° C. At 348° C. these mesogens are quite fluid and rearrange to a fairly coarse 100% anisotropic mesophase structure.
Figure 7B:
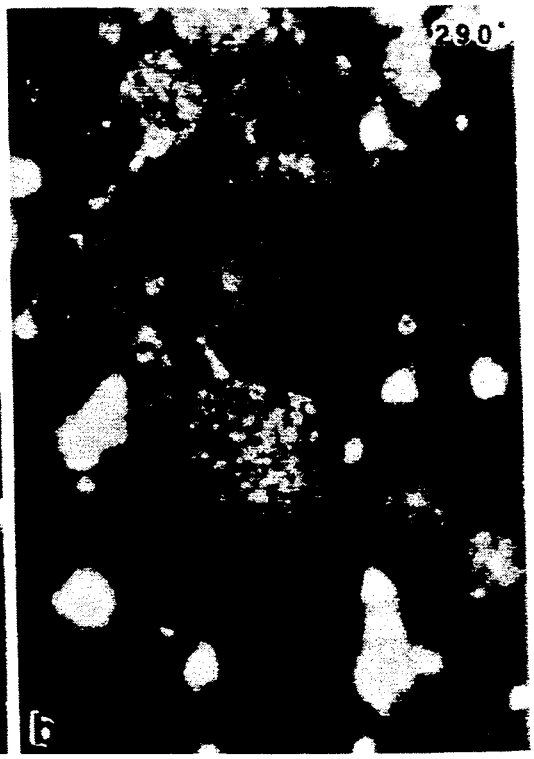
Figure 7C:
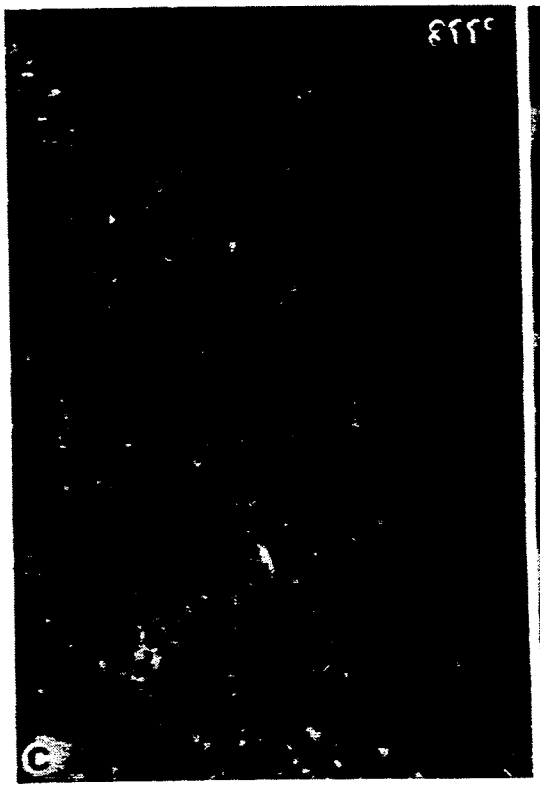
Figure 7D:
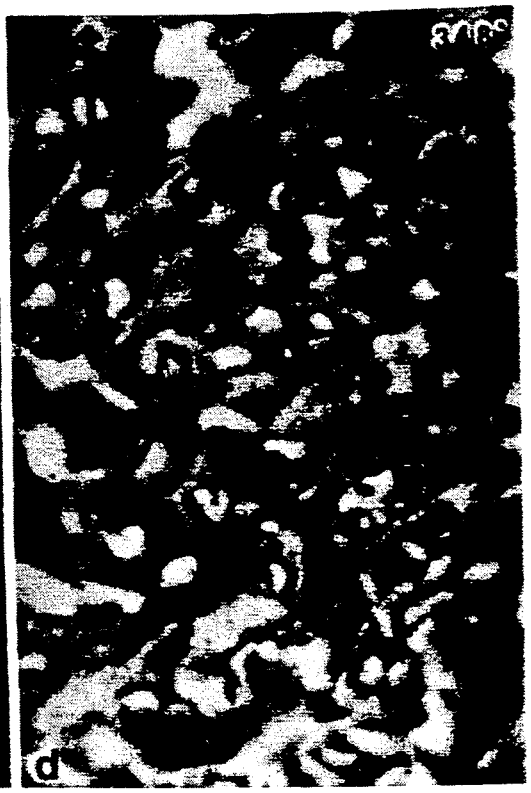

One particularly sensitive tool for measuring softening in mesophases is domain growth. Domain structure coarsens in mesophase systems when softening occurs. This can be seen in FIGS. 1 to 4 at 80° to 1OO° C. in solvated mesophase. The same type of domain coarsening occurs in the corresponding mesogens at 290° C. and above as shown in FIGS. 7B through 7D.

The melting temperature lowering that accompanies solvation of mesogens is based on comparing both the solvated and solvent-free materials by the same technique. This technique might be optical domain growth or fluidity as examples.

The liquid crystalline carbonaceous pitches of the present invention are described as mesophase pitches. Mesophase is commonly recognized by optical anisotropy when the pitch is viewed under polarized light at magnifications of 1000× or less. Anisotropic pitch, when viewed in cross section by optical microscopy, consists of extinction contour lines emanating from stacking defects called disclinations. The optical image results from light reflectance by the carbonaceous crystallites, wherein platelike aromatic molecules are stacked in sheets. The optical image can be used to describe the orientation of the aromatic molecules relative to the viewing surface. A detailed description of mesophase optical texture and structure relationships can be found in an article by J. E. Zimmer and J. L. White, "Molecular Crystallites, Liquid Crystals," Volume 38, pp. 177–193, (1977). An optical procedure for measuring percent mesophase in pitches is described in ASTM-D 4616-87. The area percent optically anisotropic fraction of a representative surface of a pitch is taken in the volume percent optical anisotropy of the material.

In the present usage mesophase pitches include pitches with very fine mesophase structures that can only be observed at magnifications exceeding 1000×. Therefore, transmission Electron Microscopy (TEM) darkfield, in addition to optical techniques, is relied upon to reveal the orientational order of mesophase structure. TEM darkfield uses the opening aperture to select crystallites of a particular orientation. The same type of structural information can be obtained from optical or TEM techniques, but TEM provides much higher resolution.

Solvated mesophase can be distinguished by composition from other solvent fractionated mesophase-forming pitches. A distinguishing characteristic is the concurrent presence of optical anisotropy and solvent. Solvated mesophase develops when mesogens or pseudomesogens are heated sufficiently to cause the onset of fluidization in the presence of solvent.

Extraction-type solvent fractionation is one way to prepare a mesophase-forming pitch. The final steps in the process determine whether or not a solvated mesophase is formed as the product. Extraction of a mesogen or pseudomesogen containing isotropic pitch gives a solid insoluble residue. This residue has been described as "neomesophase formers" which convert to a substantially anisotropic structure when heated to 230° to 400° C. However, the temperature yielding anisotropy results in loss of solvent prior to anisotropy development. Flux/rejection solvent fractionation also gives neomesophase formers that become anisotropic after solvent is removed. Both of these processes isolate mesogens or pseudomesogens.

Examples in this application show that solvent fraction can give mesogens or pseudomesogens capable of forming solvated mesophase. Solvated mesophase begins to form at 80° to 95° C. during flux/rejection solvent fractionation and continues to develop at higher temperatures as the mesogens or pseudomesogens are softened or fluidized in the presence of solvent. As the examples show, pressure is required to retain solvents above their boiling temperature.

Supercritical solvent fractionation is capable of producing solvated mesophase in situ. In practice solvent is removed or escapes from the extracted pitch before isolation such that typical solvent fractionated mesogens are produced.

There are well known non-solvent-type methods to produce mesophase pitch. Typically these methods employ thermal processing and, therefore, produce highly insoluble mesogens. Relatively soluble mesogens are preferred for making solvated mesophase. Since non-solvent methods do not use solvents, they, of course, cannot produce a solvated mesophase product.

Solvated mesophase has extremely surprising properties and appears to be a solution of predominately aromatic solvent in mesophase. The solvent causes a dramatic melting temperature decrease with minimal disruption to the stacking of the aromatic molecules, and therefore, the liquid crystalline structure of the mesophase is retained. The liquid crystal structure yields highly desirable carbon fiber and other artifact properties.

Prolonged heating of mesophase above the melting temperature during spinning often leads to decomposition and formation of coke. Solvated mesophase can be spun at much lower temperatures than the same mesogens without solvent. The liquid crystalline structure of solvated mesophase still assures good orientation and properties in the fibers.

Solvated mesophase from high melting mesogens can produce fibers that require little or no stabilization as spun. Normally, stabilization of spun fiber is one of the most costly steps in pitch carbon fiber manufacture. This stabilization (usually oxidation) is needed to prevent melting of fibers when the fibers are heated to carbonization temperature. Solvated mesophase allows the spinning at relatively low temperatures of materials that melt at much higher temperatures. Because solvated mesophase can become unmeltable on loss of solvent, the need for stabilization is eliminated or greatly reduced. When some stabilization is still required, this can be done quickly at relatively high temperatures—usually well above the spinning temperature. Removal or reduction of the stabilization step is a great cost savings for commercial processes.

Thus, the present invention allows a great advance over conventional processes for producing mesophase pitch suitable for spinning into carbon fibers. These conventional processes include both direct processes such as inert gas sparging and multi-step process such as heat soaking followed by solvent fractionation. While these processes can produce a 95 plus percent mesophase solid product with a melting point of 300° C. or higher and sometimes 250° C. and higher, if lower melting point mesophase is desired from these processes, then the percentage of mesophase in the product drops off sharply. As the melting point decreases, the mesophase percentage has heretofore been sacrificed. As shown in the examples, 100 percent anisotropic solvated mesophase can be prepared which is very fluid at 233° C.

As stated previously, solvated mesophase develops when mesogens or pseudomesogens are heated sufficiently to cause the onset of fluidization in the presence of solvent. Solvated mesophase is formed as an intermediate during solvent fractionation of mesogen (or pseudomesogen) containing heat soaked pitches. Solvent fractionation primarily comprises: fluxing the pitch in a good solvent, such as toluene, removing flux insolubles by filtration; and precipitating mesogens by diluting the flux filtrate with additional solvent (sometimes called rejection). Mesogens are then recovered from the rejection mixture as a powder by filtration in conventional solvent fractionation.

The rejection insoluble mesogens begin to develop fluidity and mesophase domain structure at very mild conditions when the rejection mixture is heated. As shown in the Examples and FIGS. 1 to 6, this softening begins near 80° C. while the mesogens are solvated in the rejection mixture. The dried solvent fractionated mesogen powder produced by this process does not begin to soften until heated above 290° C. as shown in FIGS. 7A through 7C.

Further heating of the rejection mixture to around 230° C. is shown in Examples 5 through 10 to give highly fluid large domain solvated mesophase from mesogens or pseudomesogens that vary from unmeltable to melting well above 300° C.

In more general terms, the present invention provides a method for forming a solvated mesophase comprising:

(1) combining a carbonaceous aromatic isotropic pitch with a solvent; (2) applying sufficient agitation and sufficient heat to cause the insoluble materials in said combination to form suspended liquid solvated mesophase droplets; and (3) recovering the insoluble materials as solid or fluid solvated mesophase. This process can be augmented with the additional steps of : (1) admixing the mesogen containing pitch with a solvent in about a 1 to 1 ratio to form a flux mixture and (2) filtering said mixture to remove insolubles.

The amount of heat supplied to cause the insolubles to form suspended liquid droplets can be adjusted such that the insolubles are merely softened, allowing recovery of the solvated mesophase as a particulate solid. In addition, such recovered solids can be fused under conditions that retain solvent to form solvated mesophase pitch.

The present invention also provides a method for recovering solvated mesophase from pseudomesogens comprising: (1) combining a carbonaceous aromatic pitch containing said pseudomesogens with a solvent; (2) applying sufficient heat to cause the insolubles to form suspended liquid solvated mesophase droplets or suspended solvated mesophase solids; and thereafter (3) recovering the separated insolubles, as fluid solvated mesophase, or solid particles which upon further heating form fluid solvated mesophase. In addition, solvated mesophases can be prepared by a process comprising forming a solution of solvent in mesogens or pseudomesogens wherein the mesogens or pseudomesogens are combined with between about 5 to about 40 percent solvent by weight utilizing sufficient heat and agitation to form the solvated mesophase.

Solvated mesophase can also be obtained from critical solvent separated pitches. Critical solvent fractionation is similar to conventional solvent fractionation except that rejection occurs in a single solvent system at temperatures generally above 300° C. and at pressures generally above 800 psia. The fluid mesogens separated from this system were observed to remain fluid well below their solvent-free melting temperatures and these mesogens possess large liquid crystal domain structures. Solvent loss on sampling prevented additional characterization. The presence of solvated mesophase under supercritical conditions indicates that solvated mesophase can exist at high pressures.

Solvated mesophase is often obtained or handled under conditions where solvent might be lost due to evaporation. Such evaporation must be avoided or controlled in order to maintain a homogeneous low melting solvated mesophase for spinning. Evaporation is avoided by using solvated mesophase in situ or maintaining proper saturation of the surface by adjusting composition, temperature and pressure of the surrounding medium.

As indicated, the solvated mesophase of the present invention is particularly useful for directly forming carbon fibers or other artifacts. Solvated mesophase can be heated and pressurized to the appropriate conditions and allowed to expand through an orifice, thus providing oriented carbon artifacts. Carbon artifacts can also be formed utilizing this process by injecting solvated mesophase into molds at high pressures and temperatures and allowing the solvent to escape.

In this respect, the instant invention also relates to carbon artifacts prepared from solvated mesophase, which artifacts have an oriented molecular structure. Artifacts most beneficially formed from this process are carbon fibers. Carbon fibers having oriented molecular structures which are spun from solvated mesophase experience loss of solvent through such spinning whereafter such carbon fibers will not fuse when raised to temperatures above 400° C. even without oxidative stabilization.

Solvated mesophase can be spun by conventional means such as melt or blow spinning. When these methods are used it is advantageous to prevent premature solvent loss by controlling spinning conditions and solvated mesophase composition. With carbon fibers produced by melt or blow spinning, the fusion preventing stabilization step is either unnecessary or accomplished in reduced time as compared to fibers formed from nonsolvated mesophase having the same spinning temperature. These benefits all accrue from spinning liquid solvated mesophase directly into carbon fiber.

Specifically, the present invention relates to a method for preparing oriented carbon artifacts comprising (1) combining and/or forming a mixture of a carbonaceous aromatic pitch containing mesogens or pseudomesogens and aromatic oils with a solvent; (2) applying agitation and sufficient heat and pressure to cause the insoluble materials and said combinations to form suspended liquid solvated mesophase droplets under solvent supercritical conditions of temperature and pressure; (3) effecting phase separation of the solvated mesophase from the solvent solution under solvent supercritical conditions of temperature and pressure; and (4) causing the supercritical solvent fractionated solvated mesophase to flow through an orifice to a region of lower pressure to form oriented carbon artifacts.

This method can also be carried out when the step of admixing the mesophase containing pitch with a solvent in about a 1 to 1 ratio to form a flux mixture and filtering prior to insolubilizing the mesogens or pseudomesogens (step 2) is carried out.

The instant invention is more concretely described with reference to the examples below wherein all parts and percentages are by weight unless otherwise specified. The examples are provided to illustrate the present invention and not to limit it.

EXAMPLE 1

Heat soaked heavy aromatic pitch was prepared from a mid-continent refinery decant oil topped to produce an 850° F.+ residue. The residue tested 91.8 percent carbon and 6.5 percent hydrogen and contained 81.6% aromatic hydrocarbons by $C_{13}$ nuclear magnetic resonance (NMR). The decant oil residue was heat soaked 6.3 hours at 740° F. and then vacuum deoiled to produce a heat soaked pitch. The pitch tested 16.4 percent tetrahydrofuran (THF) insoluble using 1 gram pitch in 20 milliliters (ml) THF at 75° F.

Heat soaked pitch was solvent fractionated by fluxing the pitch and then rejecting the mesogens. Crushed pitch was combined 1 to 1 weight:weight with hot toluene to form a flux mixture. The flux mixture was stirred at 110° C. until all pitch chunks had disappeared. After adding 0.14 weight percent filter aid, the mixture was filtered. Flux insolubles amounting to about 7 percent of the pitch were removed during filtration.

Hot flux filtrate was combined with additional solvent to form the rejection mixture. The solvent was 92:8 volume:volume toluene:heptane at about 80° C. Eight liters of solvent were added per kilogram of original pitch. The mixture was stirred five minutes at 83° C. The insolubles were collected by filtration and washed with cold 92:8 volume:volume toluene:heptane. The yield was about 18 percent. The product had a very fine mesophase domain structure illustrated in the FIG. 2 optical micrograph.

EXAMPLE 2

Figure 3:
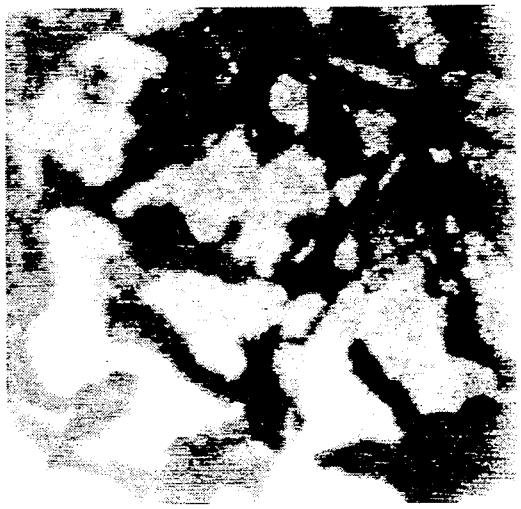
FIG. 3 is an optical micrograph of the Example 2 product which shows coarsening of the optical texture as the particles of FIG. 2 become more fluid on warming to a higher 95° C. temperature. This domain growth on warming is direct evidence of mesophase fluidity. Below the softening temperature mesophase is a frozen liquid crystalline glass with locked in domain structure. (The only time domain changes can be seen without melting is at extremely high pressure or at graphitization temperatures.) The large light colored material is the mesophase with mesophase texture appearing on the bright surface. The dark regions are the isotropic mounting medium.

The same rejection mixture described in Example 1 was heated to 95° C. prior to filtration and washing. The hot rejection insolubles were sufficiently tacky to form a solid cake on filtration. The product was washed as described in Example 1, yielding about 18 percent product by weight. The product was fine domain mesophase, as shown in FIG. 3. But the domains were coarser than the Example 1 product, illustrating that the solvated mesophase became more fluid during the hotter rejection.

EXAMPLE 3

The same heat soaked pitch as used in Example 1 was extracted by the same procedure as described in Example 1 except that the rejection solvent was 22° C. when mixed with the hot flux filtrate. The rejection mixture was stirred at the mixing temperature of 28° C. and the product was recovered by filtration. Washing followed the procedure of Example 1. The mesogens are pictured in the FIG. 1 optical micrograph. There is no evidence of mesophase domain structure. The structure shown in the figure is isotropic. This example illustrates the effect of not warming the rejection mixture.

EXAMPLE 4

The same heat soaked pitch as described in Example 1 was extracted using a similar procedure wherein the flux filtrate was combined with 6.9 liters of solvent per kilograin of pitch to make a rejection mixture. The solvent was 99:1 volume:volume toluene:heptane at near 80° C. The rejection mixture was heated to 100° C. and then cooled to 30° C. prior to recovery of precipitated mesogens. Washing procedures were carried out as described in Example 1. The product yield was about 18 percent by weight.

Figure 4:
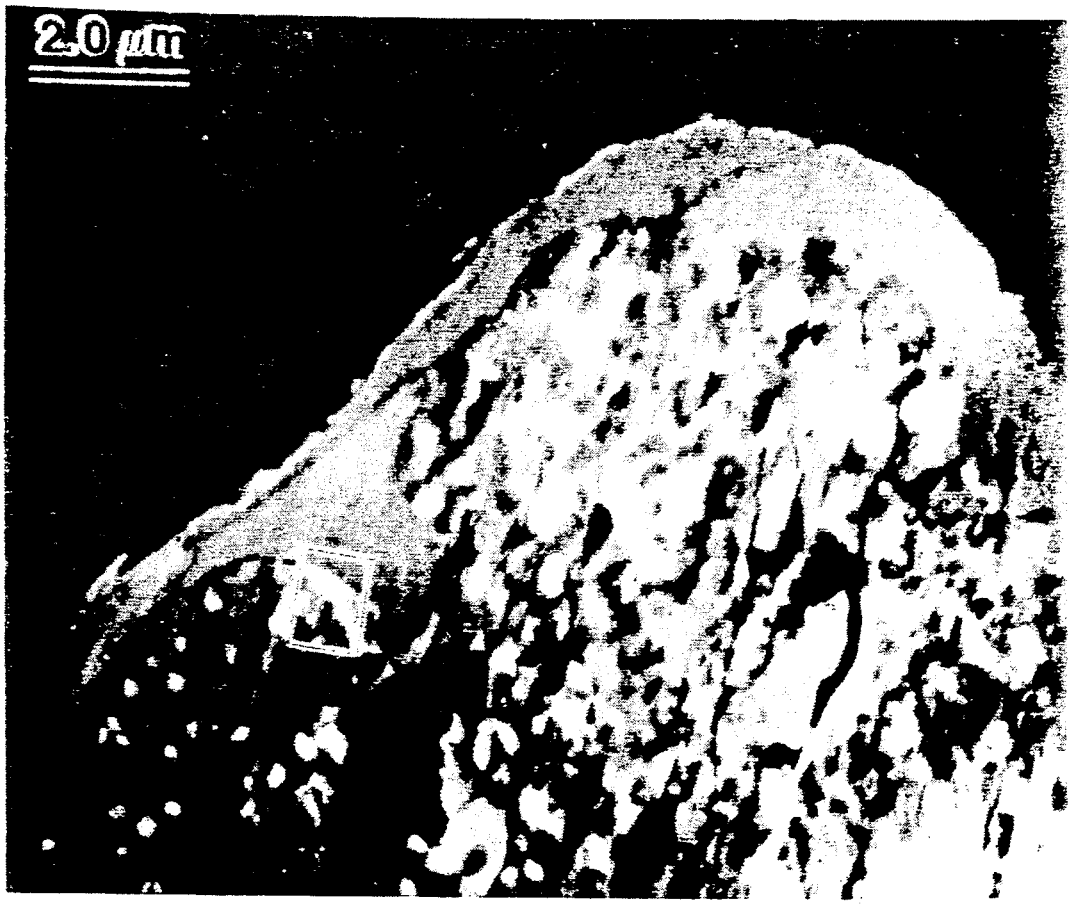
FIG. 4 is a TEM 002 darkfield micrograph which shows a solvent fractionated mesogen particle from Example 4 consisting of clusters of solidified solvated mesophase particles surrounded by isotropic pitch. The anisotropic mesophase is easily recognized by the bright and dark contrasting texture. The isotropic coating is a uniform light grey while the isotropic mounting medium is dark grey. The solvated mesophase clusters develop during a rejection warming cycle to 100° C. as previously described. The isotropic coating develops during the cool down cycle that precedes isolation of the rejection insolubles by filtering.
Figure 5A:
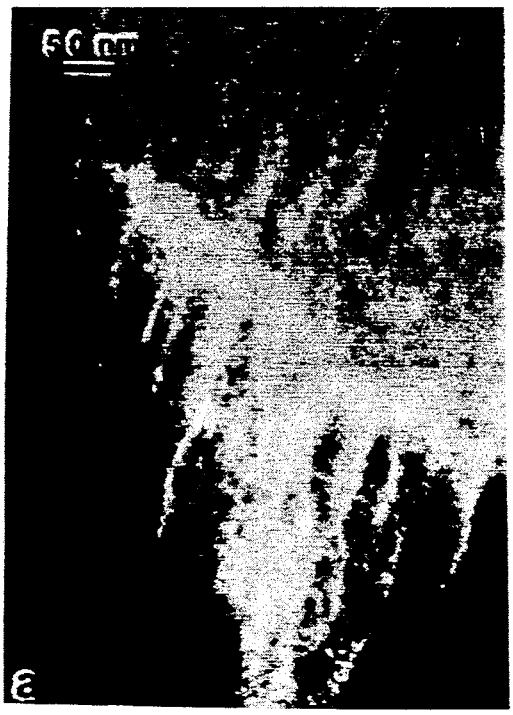
FIGS. 5A through 5D show the structure of solvated mesophase.
Figure 5B:
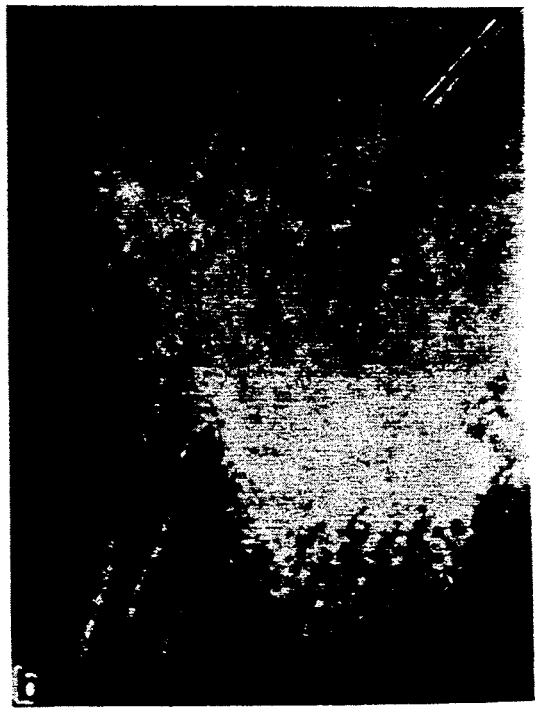
Figure 5D:
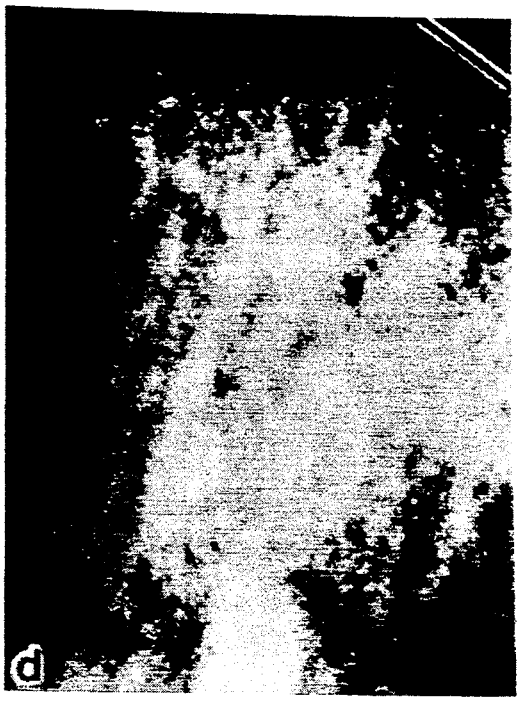
Figure 5C:
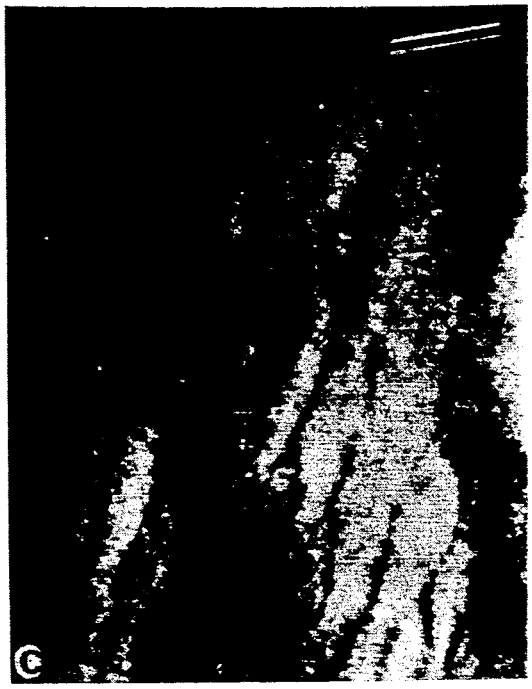
Figure 6:
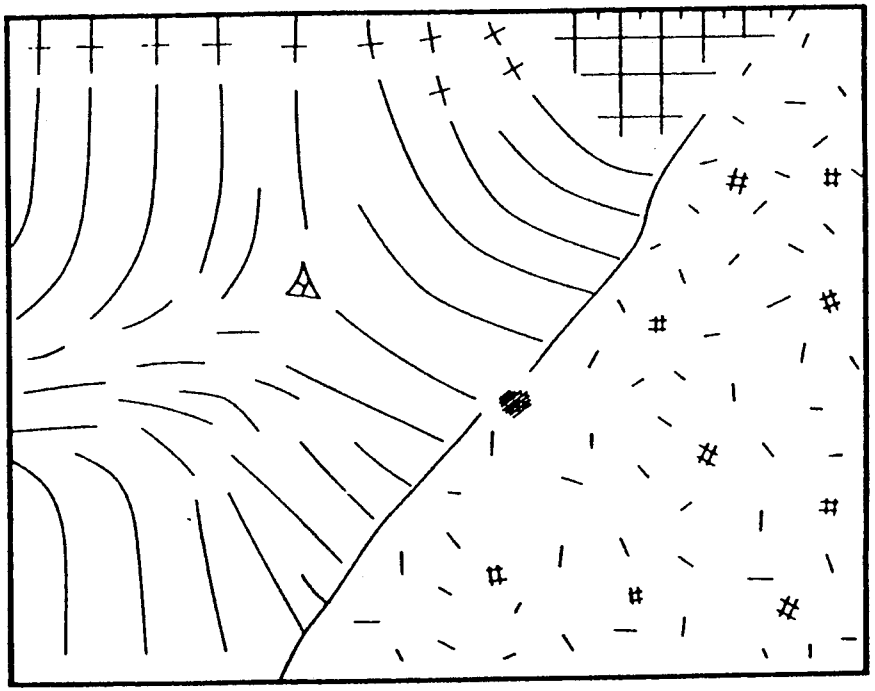
FIG. 6 is a drawing of the mesophase liquid crystal structure revealed by this technique. Note that the upper right hand portion of the region studied is isotropic. In the anisotropic region, a minus $\pi$ wedge disclination is shown, proving that the structure of even very fine structured solvated mesophase is a typical mesophase structure showing orientational order.

The product of this example was grains of solvated mesophase formed during hot rejection and coated with isotropic pitch as illustrated in the FIG. 4 optical micrograph. Considerable domain growth is evidenced in the solvated mesophase although the texture is still fine.

The melting characteristics of the product of Example 4 were measured using a thermal mechanical analyzer (TMA). The product particles began to show movement at 267° C., softened at 290° C., melted at 311° C. and flowed freely at 348° C. At 290° C. or higher the mesophase became sufficiently fluid to coarsen the solvated mesophase domain structure formed at 100° C. Changes in domain size are illustrated in the FIGS. 7A through 7D optical micrographs. The picture in FIGS. 7C and 7D show the optical texture coarsening associated with melting or fluidization of the pitch. The picture illustrates that the conventional product must be heated above 290° C. before it becomes sufficiently fluid to cause further coarsening of the structure that developed in the solvated mesophase at 100° C.

EXAMPLE 5

A heavy aromatic heat soaked pitch was prepared from an 850° F.+ residue of mid-continent refinery decant oil as described in Example 1. The decant oil residue was heat soaked 6.9 hours at 748° F. and then partly deoiled. The residue heat soaked pitch tested 20.0 percent THF insoluble.

The heat soaked pitch was extracted by combining toluene with crushed pitch in a ratio of 8 ml per gram and heating the mixture with stirring to 230° C. The extraction was done in a sealed, evacuated autoclave. Pressure of 155 psig developed at the extraction temperature. The mixture was stirred 1 hour and then allowed to settle 15 minutes at 230° C. The mixture was then cooled. Solvated mesophase product was collected 31.8% yield as a solid dense cake on the autoclave bottom after siphoning off the solvent phase and the sludge that formed during cooldown.

Figure 8:
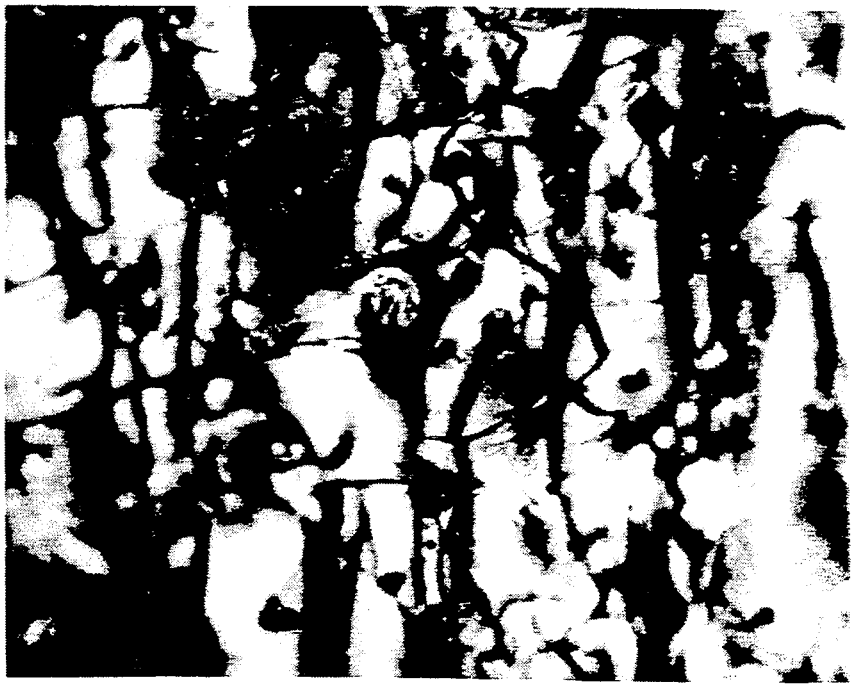
FIG. 8 is an optical polarized light micrograph of the solvated mesophase product of Example 5. The sample is 95% anisotropic with coarse optical texture. Spheres of isotropic material are suspended in the anisotropic material. Fractures develop in the material as solvent evaporates.
Figure 9:
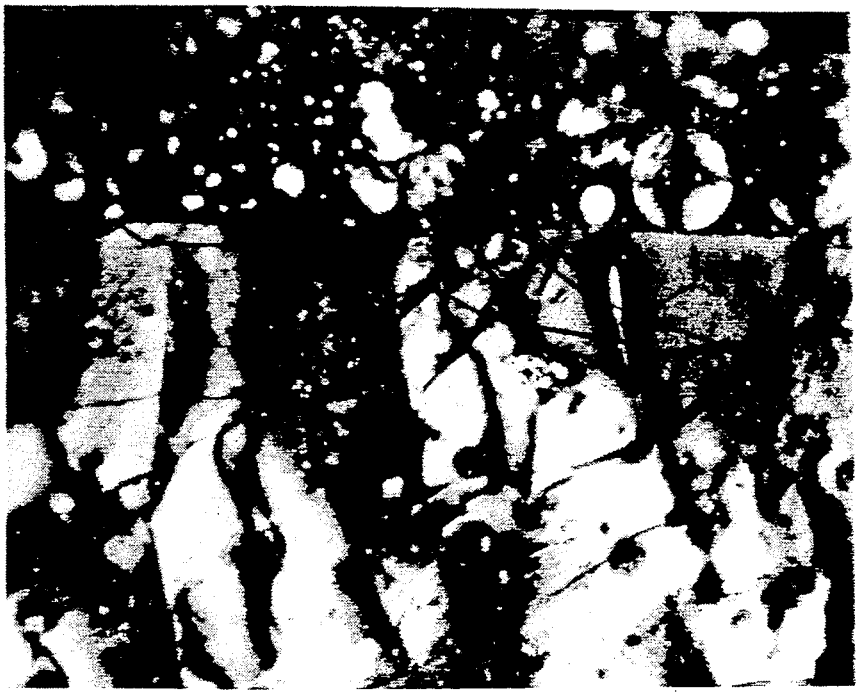
FIG. 9 is an optical polarized light micrograph of the top surface of the solvated mesophase from Example 5. A sharp boundary separates the highly anisotropic solvated mesophase that settled at 230° C. from the substantially isotropic sludge that forms during product cooldown. Mesophase spheres are evident in the sludge.

The solvated mesophase product is 95% anisotropic (area percent) as indicated by polarized light microscopy of a broken surface (FIG. 8). The settled dense cake product form shows the solvated mesophase was fluid at the 230° C. extraction and settling temperature. FIG. 9 shows the top surface of the settled product with a small amount of mesophase containing sludge adhering to the surface. The very flat demarcation line between the solvated mesophase and the sludge further illustrates the high fluidity and anisotropy of the solvated mesophase at settling conditions.

The solvated mesophase product was crushed and heated under vacuum to 360° C. to remove the 19.3 weight percent solvent. The resulting solvent free mesogens did not melt when heated on the hot stage microscope under nitrogen at 5° C. per minute to 650° C. Some sintering of the pitch did occur.

This example illustrates low pressure liquid/liquid extraction of heat soaked pitch to make a substantially self stabilizing solvated mesophase.

EXAMPLE 6

The same heat soaked pitch used in Example 5 was combined 1 to 1 by weight with toluene to form a flux mixture. The flux mixture was stirred 1 hour at 107° C. and then filtered at 99° C. to remove 9.5 percent by weight (of pitch) insolubles.

The flux filtered heat soaked pitch was extracted in an evacuated autoclave by forming a 1:1 mix by weight of the pitch in toluene at 90° C. and adding toluene until a total of 12 ml of toluene was present per gram of heat soaked pitch. This mix was stirred and heated to 230° C. where pressure reached 155 psig. The mix was stirred ½ hour at 230° C. and then allowed to settle 15 minutes at that temperature before cooling. Solid dense solvated mesophase was found in 23.5% yield on the reactor bottom.

Figure 10:
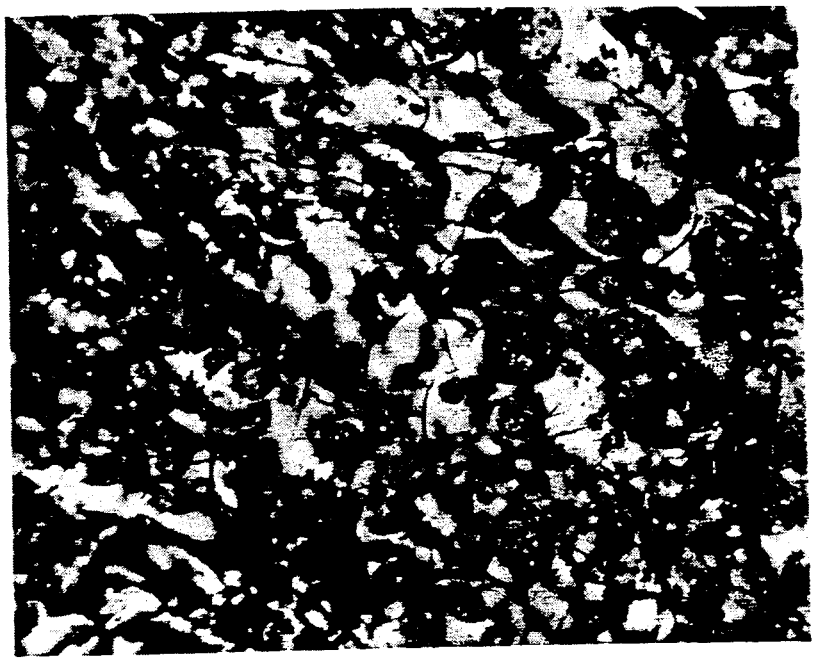
FIG. 10 is an optical polarized light micrograph of the solvated mesophase product from Example 6. The sample is 75% anisotropic with many large isotropic spheres containing small mesophase spheres.
Figure 11:
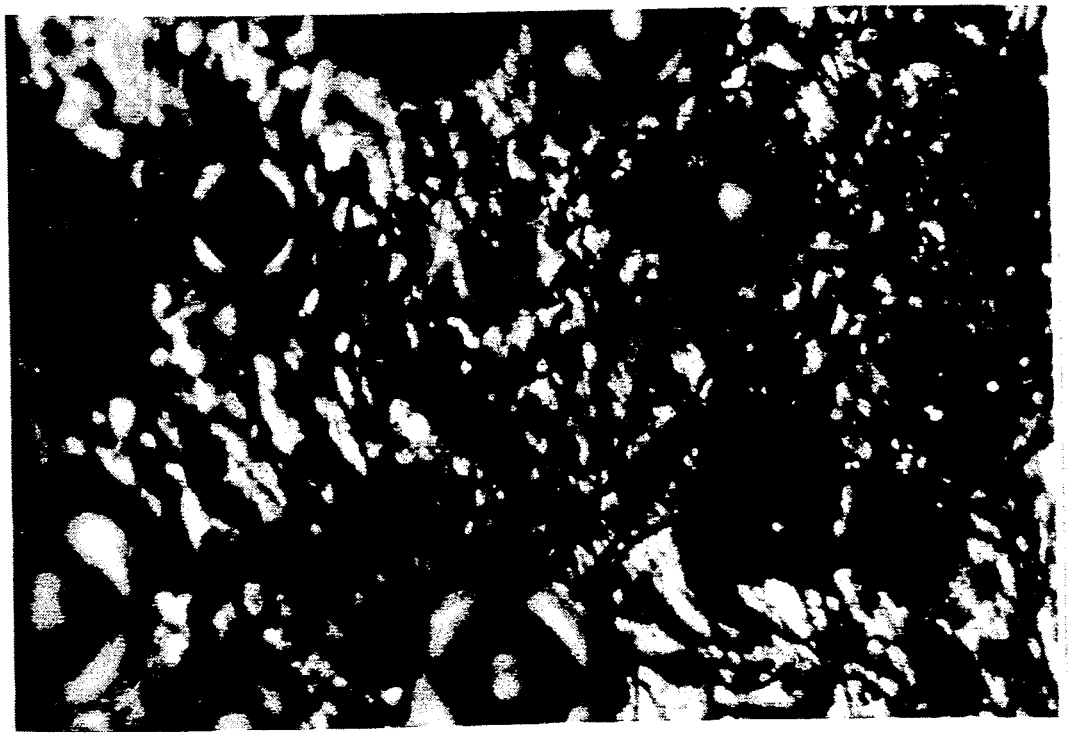
FIG. 11 is an optical micrograph of the fused, polished solvent-free mesogens from the Example 6 product. The mesogens are 100% anisotropic and the spheres are bubble holes in the fused sample.

The solvated mesophase product is 75% anisotropic by polarized light microscopy as shown in FIG. 10. When heated under vacuum to 360° C. the sample fuses and loses 22.1 weight percent solvent. The resultant solvent free mesogens soften at 335° C., melt at 373° C., and are 100% anisotropic as shown in FIG. 11.

This example illustrates the use of flux filtered heat soaked pitch to make low melting fluid solvated mesophase.

EXAMPLE 7

The same flux filtered heat soaked pitch described in Example 6 was fluxed in toluene and then combined at 8 ml per gram of original heat soaked pitch with a 90:10 volume:volume blend of toluene and heptane. The extraction at 233° C. and 180 psig follows the procedure of Example 6. Solvated mesophase was obtained in 28.8 percent yield from the autoclave bottom.

Figure 12:
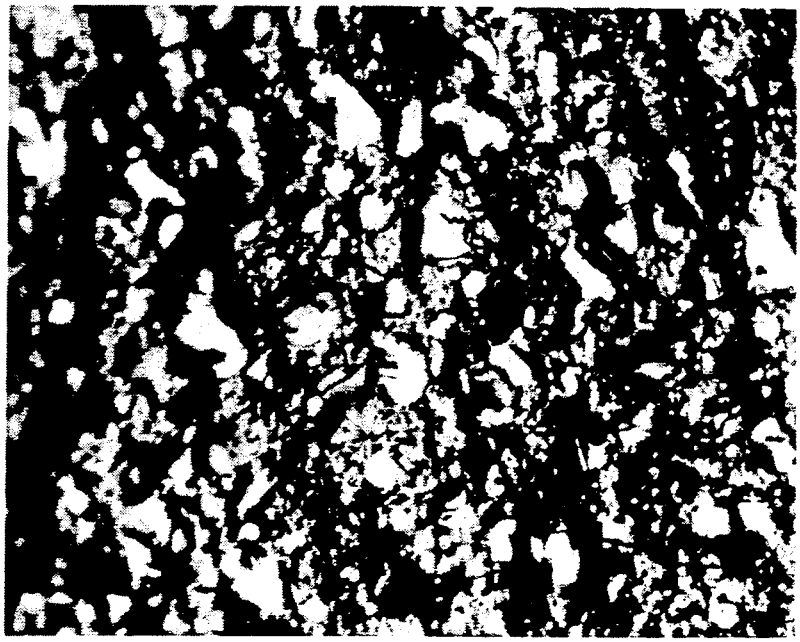
FIG. 12 is an optical micrograph of the mixed solvent toluene/heptane solvated mesophase of Example 7. The 60% mesophase in this product is large and small spheres suspended in a continuous isotropic phase.
Figure 13:
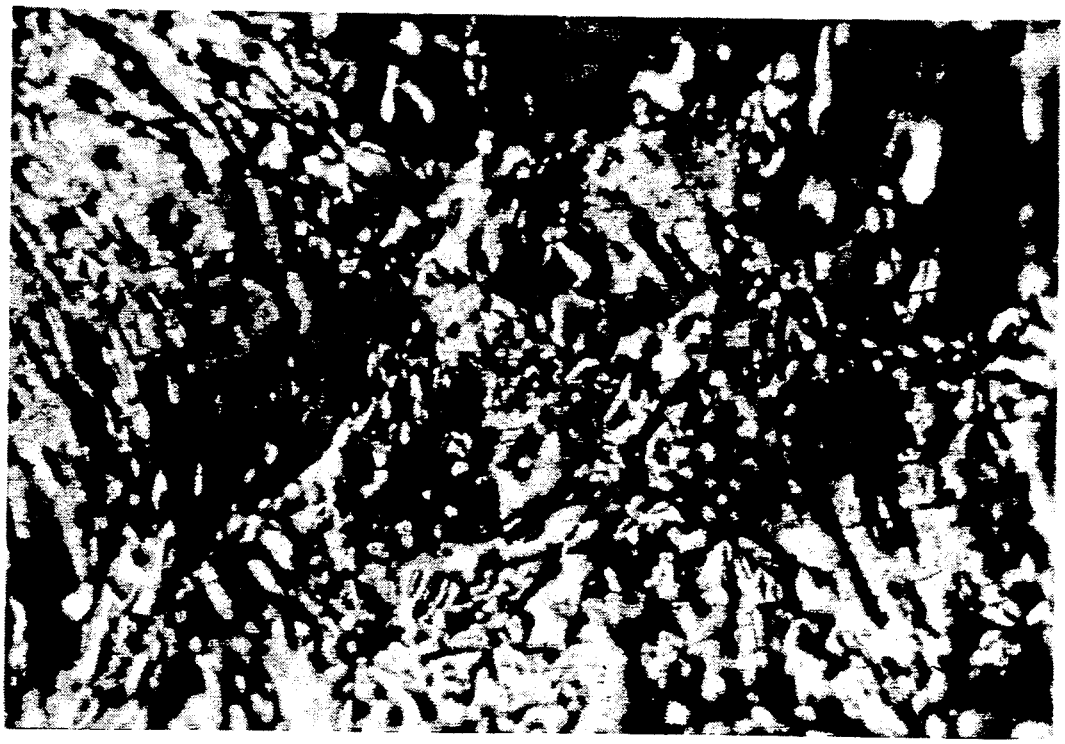
FIG. 13 is an optical micrograph of the fused, polished solvent-free mesogens from Example 7. While the solvated mesophase from this example has considerable isotropic content, the solvent-free mesogens are 100% anisotropic. The spherical region in the photograph is a bubble hole.

The solvated mesophase product is 60% anisotropic in the form of mesophase spheres suspended in isotropic pitch as in FIG. 12. When heated under vacuum to 360° C. the sample fuses and loses 23.3 weight percent solvent. The solvent free mesogens soften at 297° C., melt at 329° C., and are 100% anisotropic (FIG. 13).

This example shows the use of a mixed solvent system using a non-aromatic solvent component. The example also illustrates a lower mesophase content solvated mesophase in which the mesophase is discontinuous.

EXAMPLE 8

The same flux filtered heat soaked pitch described in Example 6 was fluxed in an equal weight of xylene at 90° C. and then combined with additional xylene to bring the xylene to pitch ratio to 8 ml per gram of original (non-flux-filtered) heat soaked pitch. Mixed xylene, containing ortho, meta, and para isomers plus ethyl benzene was used. The stirred mix was heated to 231° C. using procedures described in Example 6. The mix was stirred 30 minutes at 231° C. and 100 psi and then allowed to settle 15 minutes before cooling. Solvated mesophase was recovered as a dense cake in 23.6% yield from the autoclave bottom.

Figure 14:
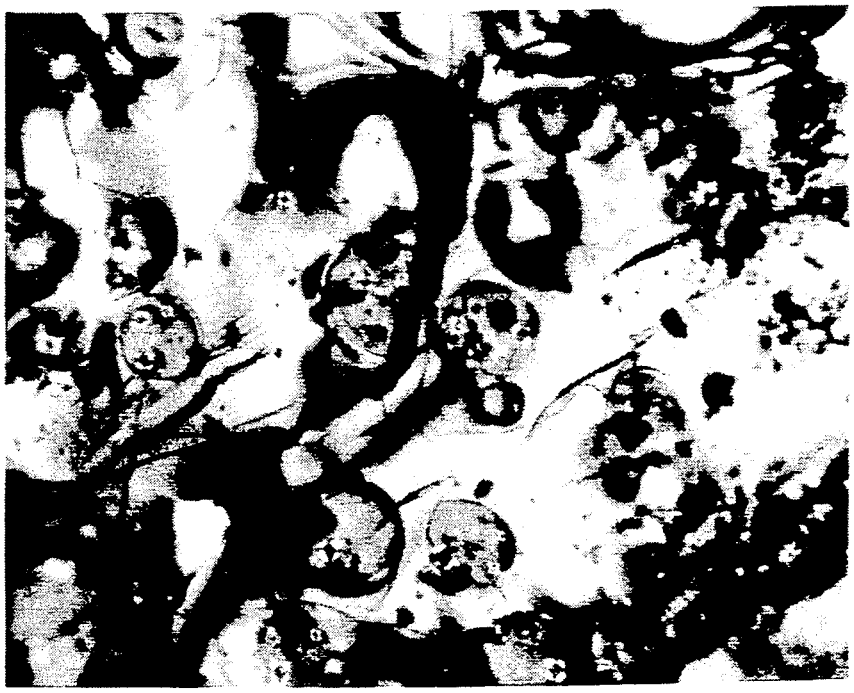
FIG. 14 is an optical micrograph of the xylene solvated mesophase of Example 8. The fracture surface shows 85% continuous coarse textured mesophase containing isotropic pitch spheres. Small mesophase spheres appear in the isotropic regions.

The solvated mesophase product is 85% anisotropic by optical microscopy as shown in FIG. 14. The product fuses and loses 21.5 weight percent solvent when heated to 360° C. under vacuum. The solvent free mesogens soften at 324° C. and partially melt at 363° C. They are 100% anisotropic.

This example shows the suitability of an aromatic solvent other than toluene and also shows a partly self stabilizing product.

Figure 15:
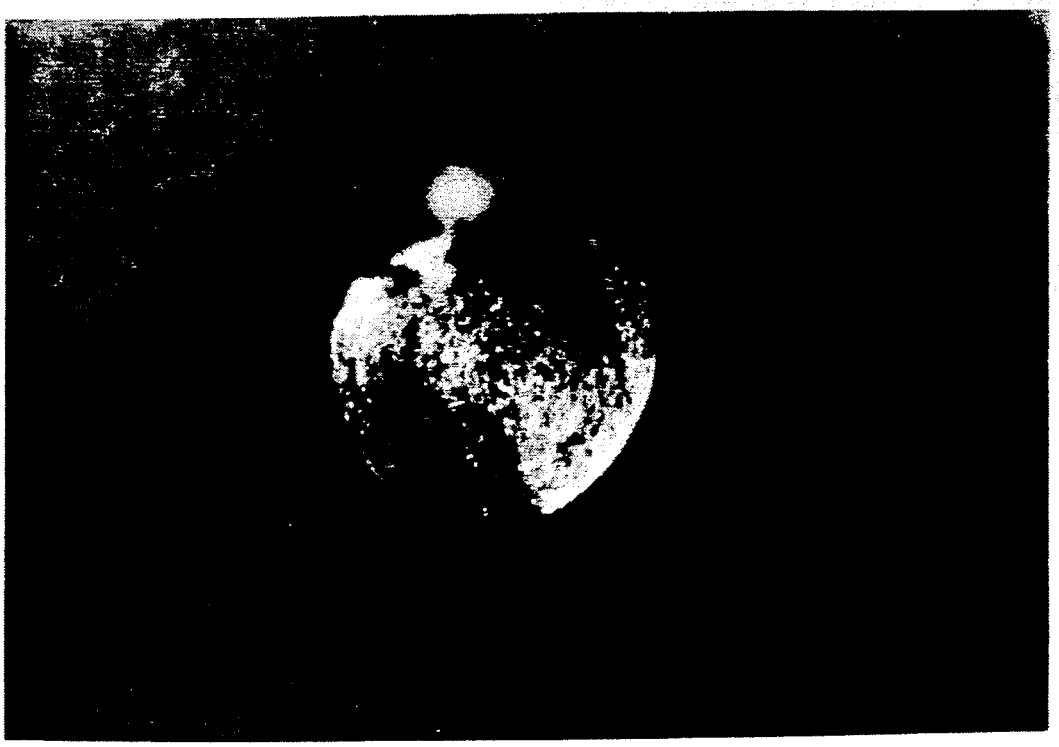
FIG. 15 is an optical micrograph of the broken end of a fat fiber spun from xylene solvated mesophase. A large bubble flaw is evident at the break. The fiber shows dark and light quadrants indicating an overall radial symmetry of the liquid crystal. Within this overall structure, one sees a fine texture consisting of numerous extinction contour lines. There are also small dull grey isotropic regions, especially near the fiber center.
Figure 16:
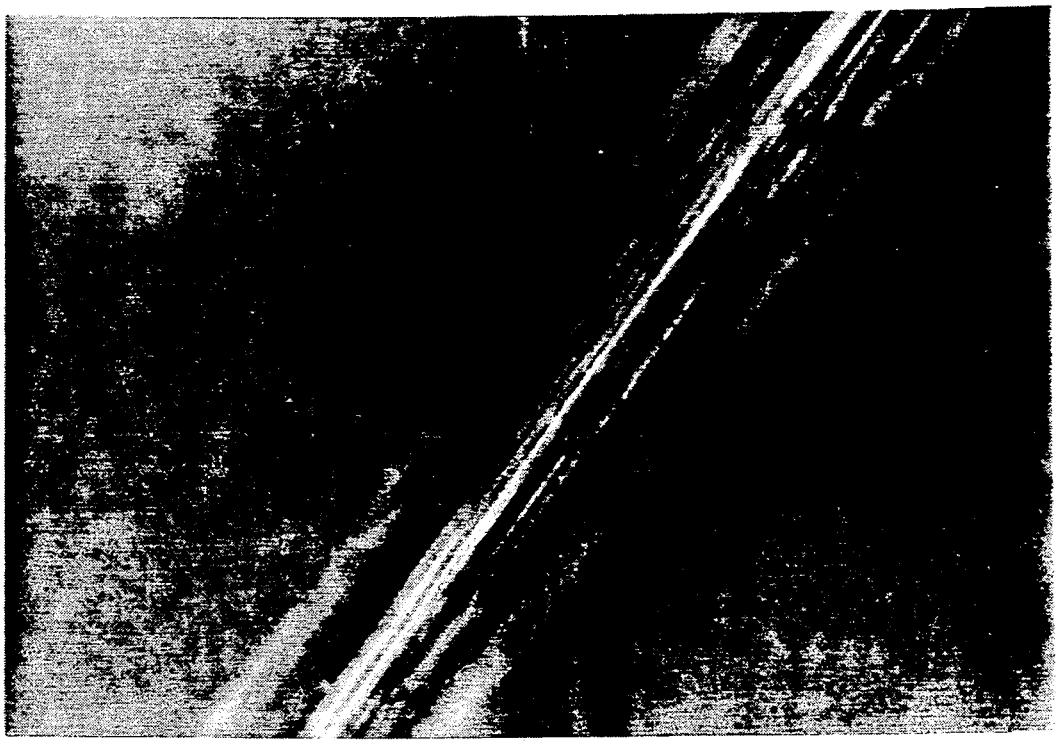
FIG. 16 is an optical micrograph along a fiber showing the elongated liquid crystal structure. The figure is a double exposure showing that the oriented mesophase is alternately bright and dark on 45 degree rotation. Exposure time is constant. Reflections cause the broad hazy image along the fiber.

A 10 g portion of xylene solvated mesophase was placed in a ½ inch diameter tube with a plate at the bottom having three 0.007 inch diameter by 0.021 inch long spinning orifices. The tube was mounted in the head of an autoclave. The pitch was melted by heating the spinning tube to 223° C. and the autoclave head to 230° C. The spinning tube was pressurized to 190 psi and the autoclave to 110 psi. The pitch flowed into the autoclave and produced a large number of unattenuated fat fibers. Photographs of these fibers (FIGS. 15 and 16) show elongated mesophase domains in a radial arrangement. The fibers demonstrate the formation of elongated oriented mesophase structures on spinning solvated mesophase.

EXAMPLE 9

The same heat soaked pitch used in Example 5 was subjected to additional vacuum deoiling to remove 19.4 weight percent volatile oils. The heavy residue was extracted as described in Example 5. An 80:20 volume:volume blend of toluene and tetralin was prepared as the extraction solvent. Eight milliliters of this solvent was combined per gram of deoiled heat soaked pitch in an evacuated autoclave. The mix was heated with stirring to 234° C. Mixing continued at 234° C. and 160 psi for one hour. After 15 minutes of settling, the mix was allowed to cool. A dense cake of solvated mesophase was recovered from the autoclave bottom in 39.6% yield.

The solvated mesophase product is 98% anisotropic as seen in the polarized light photograph of FIG. 17. The product partly fuses and loses 21.6 weight percent solvent on heating to 360° C. under vacuum. The 100% anisotropic solvent-free mesogens soften at 404° C. and melt at 427° C.

This example shows another mixed solvent system including a naphthenic solvent, tetralin. The highly anisotropic solvated mesophase gives an easily stabilized high melting pitch after solvent removal.

EXAMPLE 10

The same highly vacuum deoiled heat soaked pitch used in Example 9 was combined with toluene and aromatic oil to form an extraction mixture. The solvent consisted of a 40:1 volume:volume blend of toluene and aromatic oil. The aromatic oil was a 680°–780° F. mid-continent refinery decant oil distillate. The combined solvent was mixed with crushed pitch in a ratio of 10.1 ml per gram. This mix was stirred and heated as described in Example 5. The 233° C. extraction generated 170 psi pressure. Solvated mesophase was recovered from the cooled reaction mixture in 48.1% yield.

The solvated mesophase product was 100% anisotropic as illustrated in the polarized light micrograph of FIG. 18. The product fuses and loses 22.1% solvent on heating to 360° C. under vacuum. The solvent-free material does not melt on heating to 650° C. at 5° C. per minute under nitrogen on a hot stage microscope.

This example shows the preparation of 100% anisotropic solvated mesophase which is also self stabilizing. The example also shows that the aromatic oils are an important solvated mesophase component.

EXAMPLE 11

Toluene solvated mesophase prepared following Example 5 was vacuum dried at 150° C. and then vacuum fused at 360° C. to produce a solvent free mesophase pitch. A total of 17.1% solvent was removed. The mesophase pitch was crushed and combined with quinoline in a autoclave at a weight ratio of 7 parts pitch to 2 parts quinoline. The autoclave was sealed and evacuated. The mix was heated to 255° C. during 1 hour and 20 minutes and then stirred at 255° C. for 30 minutes. Pressure did not exceed 10 psig. The mixture was then allowed to cool at 1° to 2° per minute without stirring. The stirring motor was removed so that the stirrer could be moved by hand to detect solidification of the sample. A viscous fluid was detected by slight stirrer movement at 170° C. The cooled product was a uniform mass of solid pitch confirming formation of a single fluid phase during the experiment. Optical microscopy showed the product to be 65% anisotropic (FIG. 19). Most of the mesophase is in large coalesced domains suspended in a predominately isotropic pitch. This example shows the formation of quinoline solvated mesophase by combining solvent free mesogens and pseudomesogens with quinoline. The formation of solvated mesophase is evidence by (1) the uniform product structure with large coalesced anisotropic regions in combination with (2) fluidity far below the melting temperature of the mesophase pitch.

In Examples 12, 13 and 14, heat soaked 850° F.+ fluid. cat cracker decant oil was fluxed by conventional means utilizing toluene. The flux mixture was filtered to remove particulates down to submicron size. The filtered flux mix was used directly or solvent was then removed from the flux filtrate giving the clean, solid pitch used in the examples given below. The operating procedure was the same for each example.

In each example clean pitch and solvent were added sequentially to a two liter high pressure stirred autoclave. The system was heated to a processing temperature of 340° C. under autogenous pressure. Once the operating temperature had been reached, additional solvent was added until the operating pressure reached the desired level. The resulting mixture of pitch and solvent was agitated at 500 revolutions per minute for one hour. After an hour, the agitation was discontinued and the mixture was permitted to equilibrate and settle for 30 minutes. Following the settling period, samples were obtained at operating pressure from the top and bottom of the autoclave. Utilizing the supercritical solvent procedures, the following examples were carried out.

EXAMPLE 12

Operating conditions were 280° C. and 1873 psia using a starting mixture that was 26 percent pitch in toluene. The equilibrated bottom phase was a mixture of 80 percent solids and 20 percent volatiles. When the product material was vacuum dried at 150° C. to constant weight and the resulting solid was 100% mesophase. Vacuum fusion of a portion of the product material at 360° C. gave a 100% mesophase material melting at 348° C. The sample prepared and collected at 280° C. had a fluid anisotropic structure as observed in the 100% mesophase, 150° C. dried solid. Since drying was far below the fusion temperature of the product, the mesophase structure in the product was present when the sample was collected at 280° C. This illustrates fluid solvated mesophase existed in the equilibrated bottoms phase of the supercritical extraction at 280° C., almost 70° C. below the melting temperature of the separated mesogens.

EXAMPLE 13

Operating conditions were 340° C. and 2710 psia using a starting mixture that was 24% pitch in toluene. The equilibrated bottom phase was a mixture of 76% solids and 24 % volatiles. A 150° C. vacuum dried sample contained 100% mesophase. Vacuum fusing a portion of the product at 360° C. gave a 100% mesophase material melting at 349° C. Fluid solvated mesophase existed at the operating temperature which was about 9° C. lower than the melting point of the separated mesogens.

EXAMPLE 14

Operating conditions were 340° C. and 1420 psia using a starting mixture that was 44 percent pitch in toluene. The equilibrated bottom phase was a mixture of 81 percent solids and 19 percent volatiles. When removing the sample container from the sampling manifold, the bottoms material extruded in fiberlike fashion easily through the nominal 3/32" orifice in the valve inlet connection. The exact temperature of the valve at this time was not measured, but the valve was comfortably handleable with a gloved hand, indicating the temperature to be below 300° C. The product material found emanating from the sample container inlet valve was subsequently fused directly at 360° C. for 30 minutes. This product was 95 percent mesophase melting at 270° C.

This example shows that solvated mesophase easily forms fibers when released through a high differential pressure orifice. Although fiber forming conditions are not sufficiently documented to show spinning below the mesophase melting temperature, Examples 12 and 13 show that solvated mesophase is the expected product under the process conditions.

While certain embodiments and details have been shown for the purpose of illustrating the present invention, it will be apparent to those skilled in the art that various changes and modifications may be made herein without departing from the spirit or scope of the invention.

We claim:

1. Solvated mesophase pitch having liquid crystalline structure comprising a solvent in mesogens, pseudomesogens or mixtures thereof wherein the solvated mesophase pitch is at least 40 volume percent optically anisotropic and wherein the solvated mesophase pitch melts at least 40° C. lower than the mesogen component, or, wherein the solvated mesophase pitch contains pseudomesogens, where the solvated mesophase pitch melts or fuses and the pseudomesogen component does not; wherein the solvent dissolves in the mesogens or pseudomesogens and results in melting temperature lowering while retaining substantial liquid crystalline structure.

2. Solvated mesophase pitch as described in claim 1 wherein the amount of solvent in the solvated mesophase is from about 5 to about 40 weight percent.

3. Solvated mesophase pitch as described in claim 2 wherein the amount of solvent in the solvated mesophase is from about 10 to about 30 weight percent.

4. Solvated mesophase pitch as described in claim 3 wherein the solvent is at least one solvent selected from the group consisting of toluene, benzene, xylene, tetrahydrofuran, tetralin, choroform, heptane, pyridine, quinoline, halogenated benzenes and chlorofluorobenzenes, or 2 and 3 ring aromatics and their partly alkylated or hydrogenated derivatives.

5. Solvated mesophase pitch as described in claim 1 wherein the amount of solvent in the solvated mesophase is from about 10 to about 30 weight percent and the optical anisotropy is 90 volume percent or greater.

6. Solvated mesophase pitch as described in claim 4 having a viscosity suitable for melt spinning at temperatures up to about 360° C.

7. Solvated mesophase pitch as described in claim 1 wherein the solvated mesophase fuses at temperatures up to about 360° C.

8. Solvated mesophase pitch as described in claim 1, wherein said solvent is selected to decrease the melting temperature and to substantially preserve the anisotropic structure of the solvated mesophase.

9. Solvated mesophase pitch as described in claim 8, wherein said solvent comprises one or more solvents selected from the group consisting of toluene, benzene, xylene, tetralin, tetrahydrofuran, chloroform, heptane, pyridine, quinoline, halogenated benzenes, chlorofluorobenzenes, and 2 and 3 ring aromatic solvents and their partly alkylated and hydrogenated derivatives.

10. Solvated mesophase pitch as described in claim 9, wherein said solvent is selected to decrease the melting temperature and to preserve the anisotropic structure of the mesophase product.

11. Solvated mesophase pitch as described in claim 10, wherein said solvent comprises one or more solvents selected from the group consisting of toluene, benzene, xylene, tetralin, tetrahydrofuran, chloroform, heptane, pyridine, quinoline, halogenated benzenes, chlorofluorobenzenes, and 2 and 3 ring aromatic solvents and their partly alkylated and hydrogenated derivatives.

12. A method for forming a solvated mesophase pitch comprising: (1) combining a carbonaceous aromatic isotropic pitch containing mesogens, pseudomesogens or mixtures thereof and aromatic oils with a solvent soluble in the mesophase domain in an amount sufficient to lower the melting point of the solvated mesophase at least 40° C. below the melting point of the mesophase in a non-solvated state, and wherein said solvent is also soluble in pseudomesogens in an amount sufficient to cause the pseudomesogens to become meltable solvated mesophase, but which solvent minimally disrupts development of mesophase liquid crystalline structure formation; (2) applying sufficient agitation and sufficient heat to cause the insoluble materials in said combination to form suspended liquid solvated mesophase droplets; and (3) recovering the insoluble materials as fluid solvated mesophase.

13. A method as described in claim 12 with the additional prior steps of: (1) admixing the mesogen containing pitch with a solvent in about a 1 to 1 ratio to form a flux mixture, and (2) filtering said mixture to remove insolubles.

14. The method of claims 12 or 13 wherein the recovery of the solvated mesophase pitch is performed at or near supercritical conditions.

15. A method as described in claim 12 wherein the amount of heat supplied to cause the insolubles to form suspended liquid droplets is adjusted such that the insolubles are merely softened, thus allowing recovery of the solvated mesophase pitch as a particulate solid.

16. A method as described in claim 15 wherein the recovered solids are fused to form solvated mesophase pitch.

17. A method for recovering solvated mesophase pitch from pseudomesogens comprising: (1) combining a carbonaceous aromatic pitch containing said pseudomesogens with a solvent soluble in the pseudomesogens to an extent that causes the solvated mesophase to be meltable; (2) applying sufficient heat to cause the insolubles to form suspended liquid solvated mesophase droplets or suspended solid solvated mesophase particles; and thereafter, (3) recovering the separated insolubles as solvated mesophase in fluid form, or as solid particles, wherein the solid particles, upon further heating, form fluid solvated mesophase.

18. A solvated mesophase pitch capable of being formed into artifacts having oriented molecular structure, wherein said artifacts may be converted directly into carbon artifacts without melting in the absence of stabilization.

19. Solvated mesophase pitch prepared by a process comprising combining mesogens or pseudomesogens with from about 5 to 40 weight percent solvent and equilibrating using sufficient heat and agitation to form said solvated mesophase.

20. A method for forming an article from solvated mesophase pitch comprising: (1) combining a carbonaceous aromatic isotropic pitch containing mesogens, pseudomesogens or mixtures thereof and aromatic oils with a solvent soluble in the mesophase domain in an amount sufficient to lower the melting point of the solvated mesophase at least 40° C. below the melting point of the mesophase in a non-solvated state, and wherein said solvent is also soluble in pseudomesogens in an amount sufficient to cause the pseudomesogens to become meltable solvated mesophase, but which solvent minimally disrupts development of mesophase liquid crystalline structure formation; (2) applying sufficient agitation and sufficient heat to cause the insoluble materials in said combination to form suspended liquid solvated mesophase droplets; and (3) forming artifacts from the liquid solvated mesophase droplets.

* * * * *